US012752980B2

(12) United States Patent
Wong et al.

(10) Patent No.: US 12,752,980 B2
(45) Date of Patent: Oct. 6, 2026

(54) LID ASSEMBLY

(71) Applicant: KING'S FLAIR MARKETING LIMITED, Tortola (VG)

(72) Inventors: Siu Wah Wong, Tortola (VG); Chi Yeung Chan, Tortola (VG); David Randall Knott, Tortola (VG); John Patrick Rose, Tortola (VG); Fat Sun Kwok, Tortola (VG); Ho Yan Leung, Tortola (VG); Tsan Ho Chan, Tortola (VG); Shun Sang Poon, Tortola (VG); Chun Na Wong, Tortola (VG)

(73) Assignee: KING'S FLAIR MARKETING LIMITED, Tortola (VG)

( * ) Notice: Subject to any disclaimer, the term of this patent is extended or adjusted under 35 U.S.C. 154(b) by 0 days.

(21) Appl. No.: 19/191,211

(22) Filed: Apr. 28, 2025

(65) Prior Publication Data

US 2025/0340339 A1 Nov. 6, 2025

Related U.S. Application Data

(60) Provisional application No. 63/642,195, filed on May 3, 2024.

(51) Int. Cl.
*B65D 47/08* (2006.01)
*B65D 51/18* (2006.01)

(52) U.S. Cl.
CPC ..... *B65D 47/0871* (2013.01); *B65D 47/0866* (2013.01); *B65D 47/0885* (2013.01);
(Continued)

(58) Field of Classification Search
CPC ..... B65D 47/0871; B65D 47/0828; B65D 43/14; B65D 43/16; B65D 43/163;
(Continued)

(56) References Cited

U.S. PATENT DOCUMENTS 11,447,308 B1 * 9/2022 Lin ..... B65D 47/0857
2017/0253395 A1 * 9/2017 Matthis ..... A47G 19/2272
(Continued)

*Primary Examiner* — Javier A Pagan
(74) *Attorney, Agent, or Firm* — WPAT, PC

(57) ABSTRACT

The present invention is about a lid assembly, for a container, comprising: a main member, removably mounting to said container, having: a passage fluidically communicable with the interior of said container, a through-hole; and an engagement member; an actuation system, comprising a button portion, having an engagement member, said button portion reciprocally movable inside said through-hole of said main member between a first position and a second position with a first resilient member; and a first connector portion, adjacent said main member and having an engagement member engageable with said engagement member of said button portion, such that said first connector portion being actuated to move, synchronously with the movement of said button portion, between a first position and a second position; a lid, movably connecting to said first connector portion with a first biasing member and having an engagement member engageable with said engagement member of said main member, said lid being: maintained at a first position covering said passage when said engagement member of said lid engaging with said engagement member of said main member; and operably moved with said first biasing member to a second position uncovering said passage when said engagement member of said lid disengaging from said engagement member of said main member; a sealing structure, directly or indirectly connecting to said main member and being actuated to move between a first position closing said passage and a second position opening said passage; and characterized in that, said button portion moving from its said first position to said second position synchronously: actuating said sealing structure and said first connector portion to move from their said first position to said second position; and disengaging said engagement
(Continued)

member of said lid from said engagement member of said main member.

15 Claims, 19 Drawing Sheets

(52) U.S. Cl.
CPC ..... *B65D 51/18* (2013.01); *B65D 2251/0025* (2013.01); *B65D 2251/0046* (2013.01); *B65D 2251/1058* (2013.01); *B65D 2251/1066* (2013.01); *B65D 2251/20* (2013.01)

(58) Field of Classification Search
CPC .. B65D 43/164; B65D 43/165; B65D 43/166; B65D 43/167; B65D 43/168; B65D 43/18; B65D 43/20; B65D 47/08; B65D 47/0804; B65D 47/0809; B65D 47/0814; B65D 47/0819; B65D 47/0823; B65D 47/0833; B65D 47/0857; B65D 47/0861; B65D 47/0866; A61J 9/00; A47G 19/2272; A45F 3/16
USPC ..... 220/715
See application file for complete search history.

(56) References Cited

U.S. PATENT DOCUMENTS

| | | | | |
|---|---|---|---|---|
| 2021/0086961 | A1* | 3/2021 | Pinelli ..... | B65D 47/0871 |
| 2022/0135294 | A1* | 5/2022 | Peng ..... | B65D 47/0871 220/203.01 |
| 2025/0304336 | A1* | 10/2025 | Bytheway ..... | B65D 47/0871 |

* cited by examiner

LID ASSEMBLY

FIELD OF THE INVENTION

The present invention is related to a lid assembly. Specifically, the present invention is related to a lid assembly which has simplified design allowing all the components of the lid assembly that can be disassembled.

BACKGROUND OF THE INVENTION

Various drinking containers commonly found in the art typically consist of a container body and a lid secured to it. The lid includes a mechanism designed to open or close a liquid passage that connects the interior of the container body to the exterior. In some existing lid assemblies, they are designed structurally complex, bringing inconveniences to users. Even worse, the complex components are tiny and cannot be disassembled, causing hygienic concerns. As a result, the invention addresses the need for a lid design featuring with simple design.

The present invention seeks to address the problem above, or at least to provide an alternative to the public. In particular, the present invention provides an advantage that all the components of the lid assembly that can be disassembled for cleaning.

SUMMARY OF INVENTION

The first aspect of the present invention is about a lid assembly, for a container, comprising: a main member, removably mounting to said container, having: a passage fluidically communicable with an interior of said container, a through-hole; and an engagement member; an actuation system, comprising a button portion, having an engagement member, said button portion reciprocally movable inside said through-hole of said main member between a first position and a second position with a first resilient member; and a first connector portion, adjacent said main member and having an engagement member engageable with said engagement member of said button portion, such that said first connector portion being actuated to move, synchronously with the movement of said button portion, between a first position and a second position; a lid, movably connecting to said first connector portion with a first biasing member and having an engagement member engageable with said engagement member of said main member, said lid being: maintained at a first position covering said passage when said engagement member of said lid engaging with said engagement member of said main member; and operably moved with said first biasing member to a second position uncovering said passage when said engagement member of said lid disengaging from said engagement member of said main member; a sealing structure, directly or indirectly connecting to said main member and being actuated to move between a first position closing said passage and a second position opening said passage; and characterized in that, said button portion moving from its said first position to said second position synchronously: actuating said sealing structure and said first connector portion to move from their said first position to said second position; and disengaging said engagement member of said lid from said engagement member of said main member.

In some embodiments, said sealing structure comprising a second connector and a sealing member, said second connector and said sealing member being actuated, by the movement of said button portion, to move between a first position and a second position, wherein: said sealing structure moving between its said first position and said second position referring to said second connector and said sealing member moving between their respective said first position and said second position.

In some embodiments, further comprising a second biasing member, provided to said second connector to facilitate the movement of said second connector between its said first position and second position.

In some embodiments, said main member providing a track guiding the movement of said sealing member between its said first position and said second position.

In some embodiments, said lid sliding with a certain extent with respect to the main member before said first biasing member relaxes.

In some embodiments, said lid sliding in a direction away from said main member.

In some embodiments, said first connector portion being assembled to said main member, with a second resilient member therebetween, such that said first connector portion being movable between its said first position and second position and moving with respect to said main member.

In some embodiments, a movable connection between said first connector portion and said lid being adjacent said button portion.

In some embodiments, a movable connection between said first connector portion and said lid being movable with respect to said main member.

In some embodiments, further comprising a stage, movably connecting to said main member, such that said stage being configured to assume a first orientation and a second orientation; and said sealing structure movably connecting to said stage.

In some embodiments, said stage being provided with a third biasing member, such that in said first orientation said stage biasing said third biasing member.

In some embodiments, said main member further comprising an auxiliary engagement member; said stage being further provided with an engagement member engageable with said auxiliary engagement member, aiding said stage to maintain its said first orientation.

In some embodiments, when said engagement member of said stage not engaging with said auxiliary engagement member, relaxation of the biased third biasing member reflexing said stage from its said first orientation to said second orientation.

In some embodiments, said button portion and said first connector portion being separate parts.

In some embodiments, said button portion and said first connector portion being integrally formed, said engagement member of said first connector portion and said engagement member of said button portion being permanently engaged.

DESCRIPTION OF THE DRAWINGS

Some embodiments of the present invention will now be explained, with reference to the accompanied drawings, in which:—

DETAILED DESCRIPTION OF PREFERRED EMBODIMENTS OF THE INVENTION

Figure 1A:
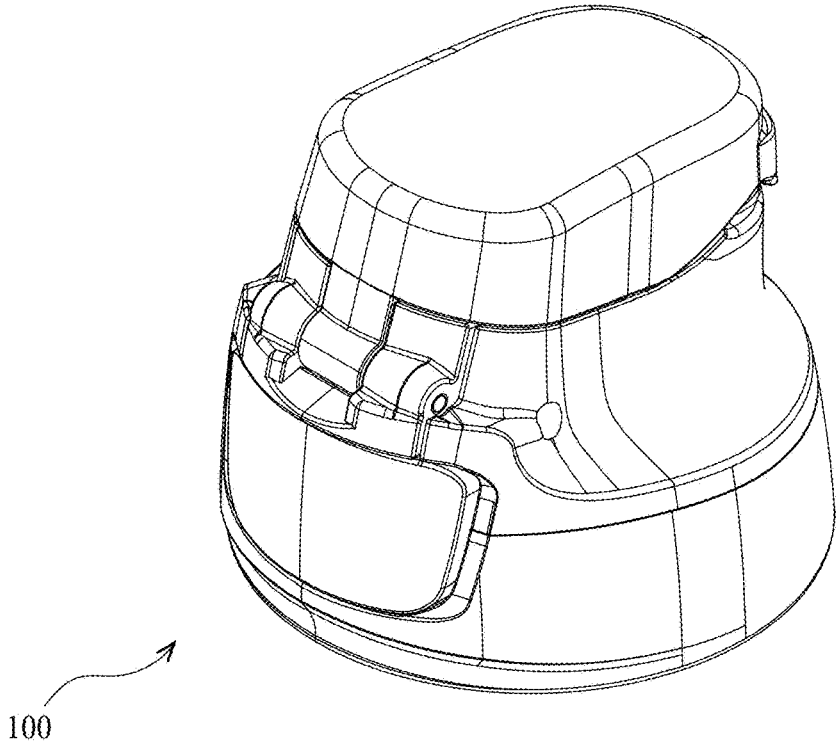
FIGS. 1A and 1B are perspective views of a lid assembly of the present invention.

The present invention is now presented by way of examples with reference to the figures in the following paragraphs. Objects, features, and aspects of the present disclosure are disclosed in or are apparent from the following description. It shall be understood by one of ordinary skilled in the art that the following description is a description of exemplary embodiments only, and is not intended as limiting the broader aspects of the present disclosure, which broader aspects are embodied in the exemplary constructions.

It should be noted that, unless otherwise defined, the technical terms or scientific terms used in the embodiments of the present invention shall have the usual meanings understood by person with ordinary skills in the art to which the present invention belongs. "First", "second" and similar expression used in the embodiments of the present invention do not indicate any order, quantity or importance, but are only used to distinguish different components. "Front", "rear", "left", "right", "upper", and "lower" and other terms indicating orientation or similar terms are only described for the exemplary relative positional relationship shown in the drawings to facilitate the understanding. It does not limit the disclosed components in the present invention can only follow this specific relative positional relationship. "Connect or the like", "mount or the like" or "secure or the like" or "assemble or the like" is not limited to physical or mechanical connections, whether direct or indirect.

Figure 1B:
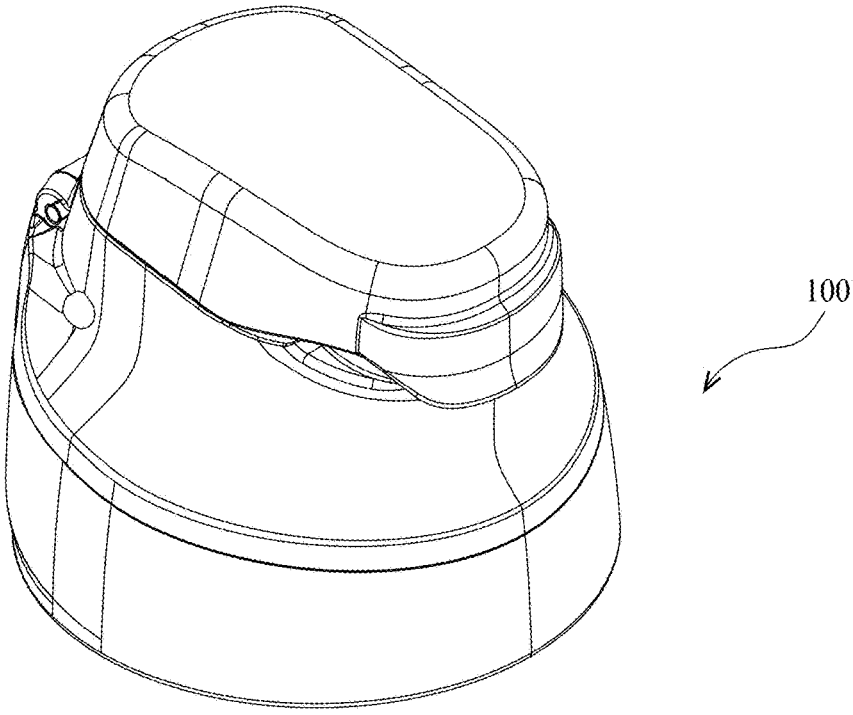

Referring now to the drawings, FIGS. 1A-1B illustrate a lid assembly 100 of the present invention for a container. The container has a top opening; however, for clarity's sake it is not shown in the figures. The lid assembly 100 can be configured to connect to the container 100 for removably covering the top opening. The container is used to contain or store contents such as beverage and may be of any type known liquid in the art.

Figure 2:
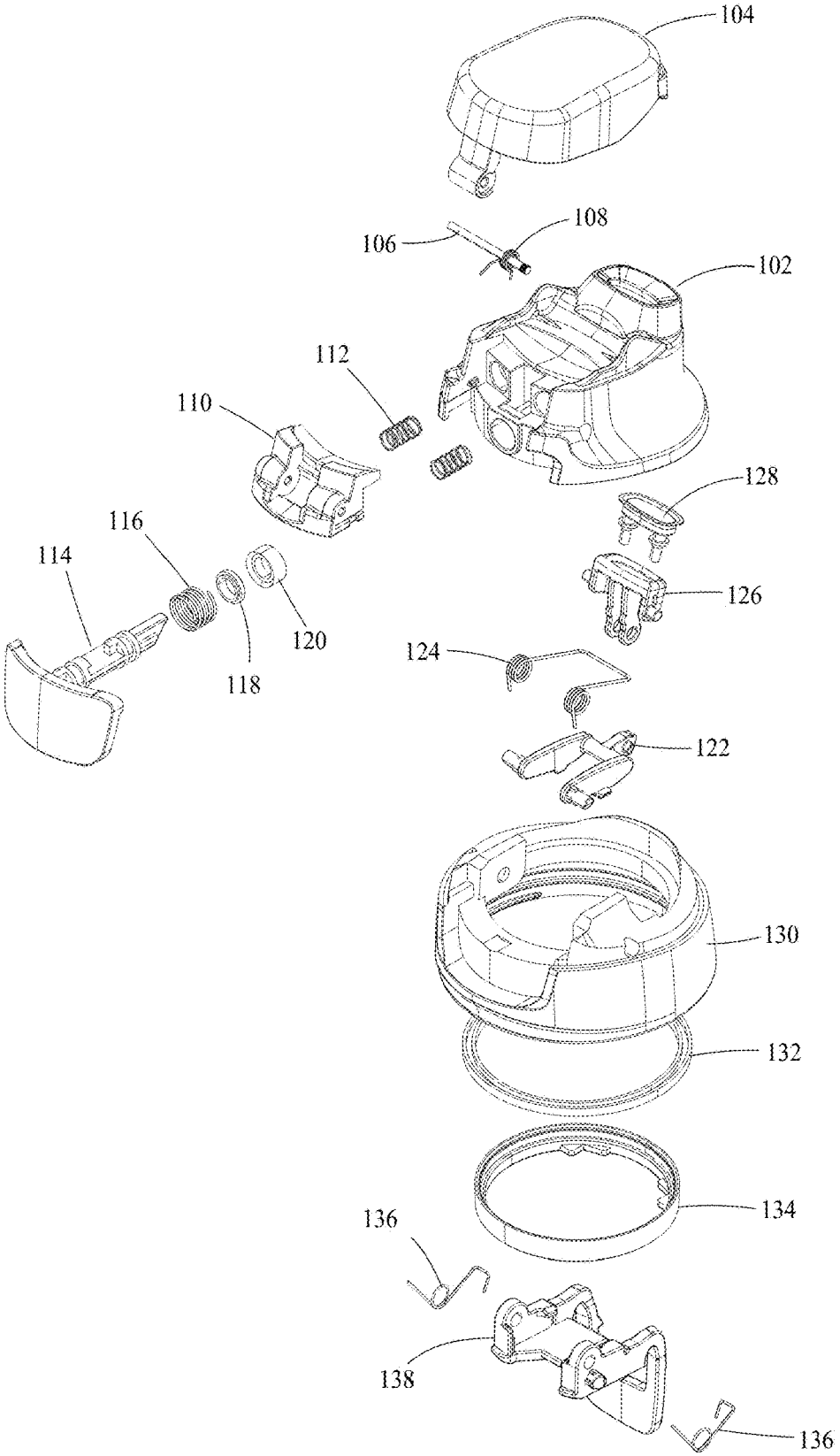
FIG. 2 is an exploded view showing the lid assembly of the present invention.

FIG. 2 is an exploded lid assembly 100. The lid assembly 100 comprises a main body 102, a lid 104, an axle 106, a biasing member 108, a connector portion 110, a resilient member 112, a button portion 114, a resilient member 116, a seal 118, a seal 120, a connector 122, a biasing member 124, a connector 126, a seal 128, a base member 130, a seal 132, an adapter 134, a biasing member 136, and a stage 138.

Figure 3A:
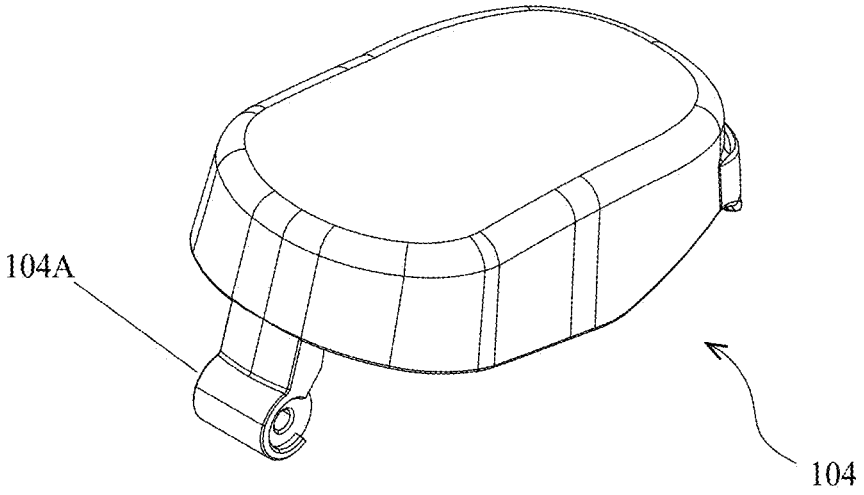
FIGS. 3A-3B are different views of a lid of the lid assembly of the present invention.
Figure 3B:
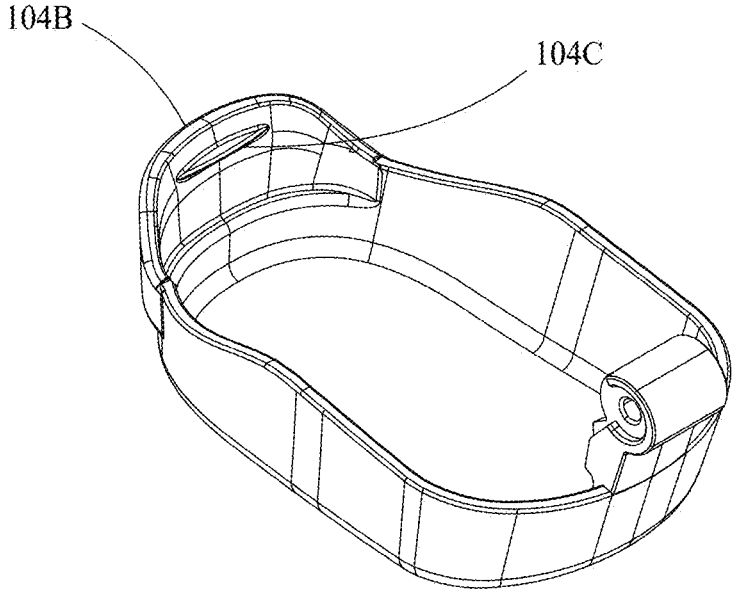

FIGS. 3A and 3B illustrate different views of the lid 104. The lid 104 is engineered with two distinct ends: the first end 104A and the second end 104B, each serving a specific purpose in the mechanism's operation. The first end 104A of the lid is designed to enable a movable, specifically rotatable, connection to the main body 102. This connection is facilitated by the axle 106, which acts as a pivot point, and the biasing member 108, which applies force to control or assist movement. To accommodate the axle, the first end 104A is constructed with a pair of holes, allowing the axle to be inserted and secured, thereby anchoring the lid in a way that permits it to rotate relative to the main body. Opposite the first end is the second end 104B, which also plays a critical role in the lid's function. The lid itself is shaped or structured as a receptacle, suggesting that it is hollow or cupped to some degree, likely to encase or interface with another part. In the receptacle at the second end 104B, there is an engagement member 104C, ideally formed as a hook. This hook-like engagement member 104C is tasked with interacting with the main body 102—presumably latching onto or hooking into a corresponding feature on the main body to secure the lid in place when closed. The interplay between the axle 106 and the biasing member 108 allows the lid to operate between two discrete positions: a first position, in which the lid is engaged or closed onto the main body, and a second position, in which the lid is disengaged or opened away from the main body. The biasing member 108—most likely a spring or similar elastic component—is preloaded when the lid is in the first position. This means that it is under tension or compression, storing potential energy. When the lid is moved out of the first position, this stored energy is released as the biasing member relaxes. This relaxation process assists in propelling the lid from the closed (first) position to the open (second) position, effectively providing a spring-loaded opening mechanism. This design not only enables ease of operation but also enhances user experience by automating part of the movement, reducing the effort required to open the lid. It also likely contributes to a more consistent and controlled motion, which can be important for safety, durability, or tactile feedback.

Figure 4B:
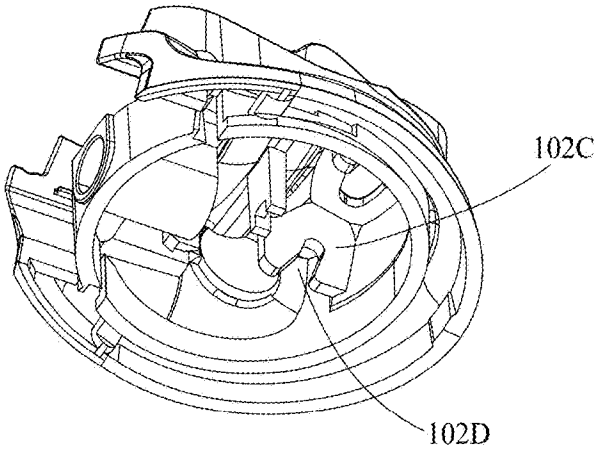
FIGS. 4A-4D are different views of a main body of the lid assembly of the present invention.
Figure 4D:
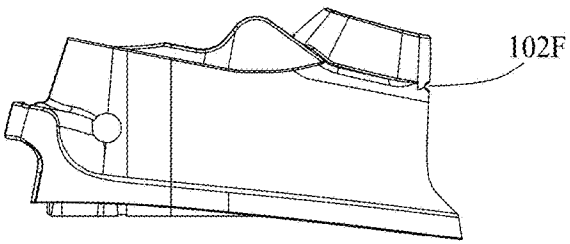
Figure 4A:
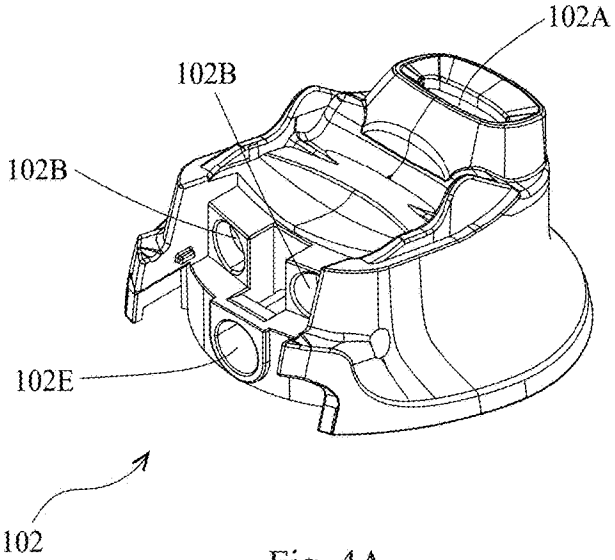
Figure 4C:
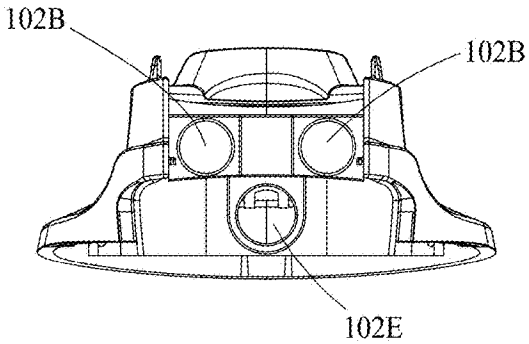

FIGS. 4A-4C illustrate different views of the main body 102 of the lid assembly according to the present invention. The main body 102 is designed to include a passage 102A, which serves an important role in fluid communication. This passage is configured in such a way that it can be fluidically communicable with the interior of a container, allowing substances—such as liquids or gases—to move between the interior of the container and the passage itself. This suggests that the lid assembly is part of a system that regulates or enables the controlled flow of fluid, likely with applications in dispensing, sealing, or ventilation. The main body also includes a specific through-hole, designated as 102E, which is intended to receive a button portion 114. This implies that the button portion is an actuating component, possibly used to trigger or control a function such as opening the lid, releasing fluid, or engaging a sealing mechanism. The positioning and sizing of the through-hole 102E are therefore critical to ensuring the button portion can operate smoothly and interact properly with the rest of the internal components. Adjacent to the through-hole 102E is a recessed area molded or formed into the structure of the main body 102. This recessed area is sized to accommodate the connector portion 110, which is likely part of the mechanical structures within the lid assembly. Within this recessed area, the design includes two apertures labeled as 102B, which are intended to receive the resilient members 112. These resilient members may be springs or elastomeric elements that provide a restoring force or help in maintaining contact or pressure between components. However, the design allows for flexibility. In some embodiments, the recessed area may be configured to include only one aperture 102B and one resilient member 112. This indicates that the number of apertures or resilient members is not a fixed feature and should not be interpreted as limiting the scope of the invention. Instead, it reflects a modular or adaptable design that can be customized based on the desired performance characteristics or manufacturing constraints. Looking deeper into the internal structure, the interior of the main body 102 includes a pair of standing walls labeled as 102C. These walls extend vertically from the bottom side of the top surface of the main body, forming an internal guiding or structural framework. The standing walls 102C are not merely structural supports; they are functionally significant because they are equipped with tracks. These tracks are instrumental in guiding the movement of a sealing member, which comprises two main parts: the connector 126 and the seal 128. The tracks on the standing walls 102C likely ensure that the connector 126 and seal 128 move in a controlled, linear, or guided manner-crucial for maintaining effective sealing when the lid is closed and ensuring proper disengagement when it is opened. This guided movement also contributes to the mechanical reliability and precision of the lid's operation, particularly in applications requiring repeated opening and closing or pressure sealing. On the peripheral wall of the main body 102, adjacent to the passage 102A, an engagement member 102F is provided, as shown in FIG. 4D. Preferably, the engagement member 102F is in the form of a notch that is engageable with the engagement member 104C (the hook) of the lid 104.

Figure 5C:
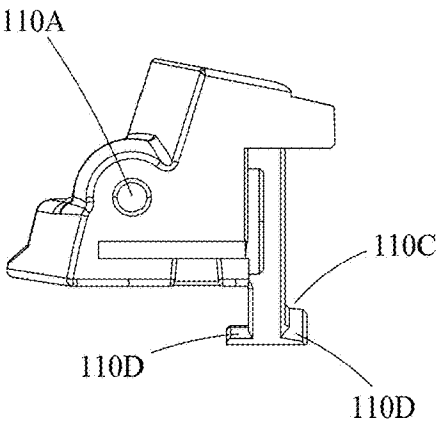
FIGS. 5A-5C are different views of a connector of the lid assembly of the present invention.
Figure 5B:
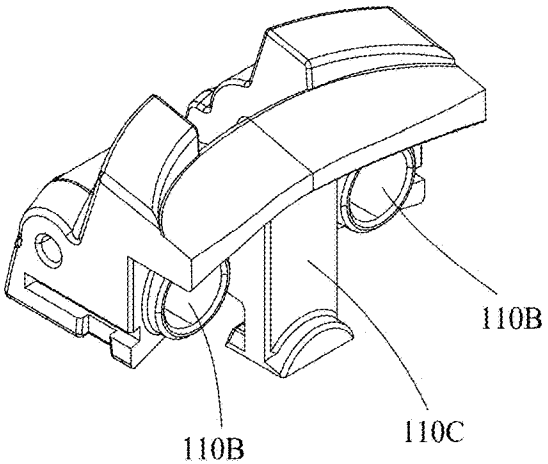
Figure 5A:
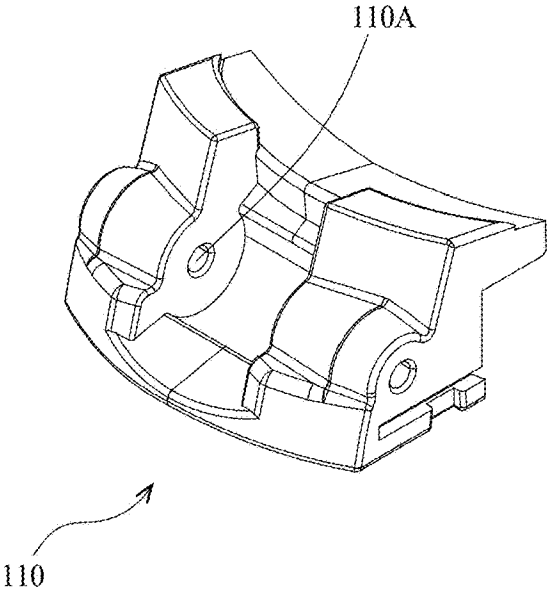
Figure 6B:
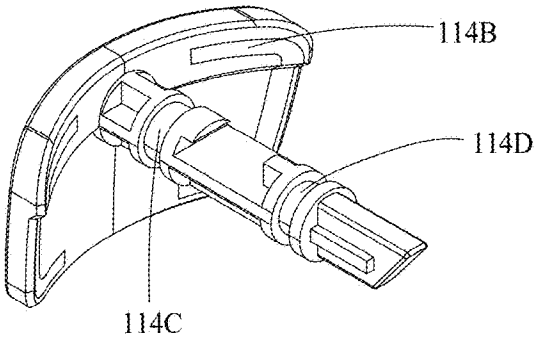
FIGS. 6A-6D are different views of a button portion of the present invention.
Figure 6D:
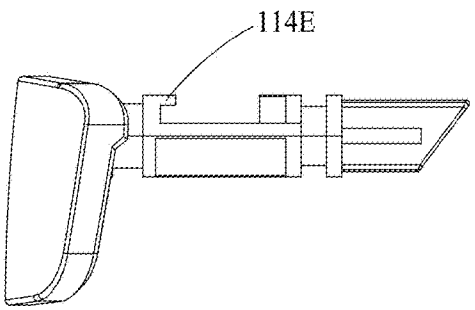
Figure 6A:
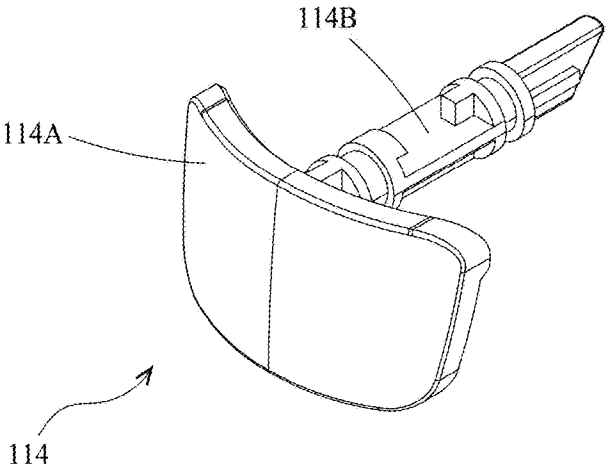
Figure 6C:
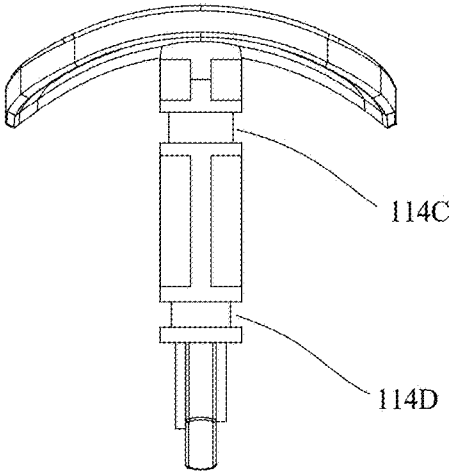
Figure 7B:
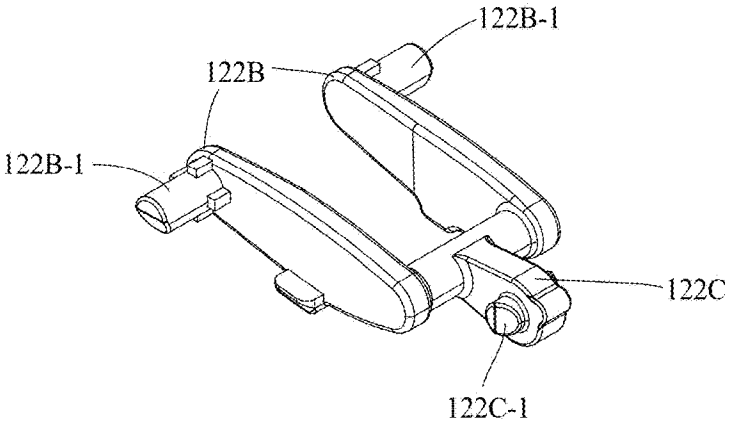
FIGS. 7A-7D are different views of a connector of the present invention.
Figure 7D:
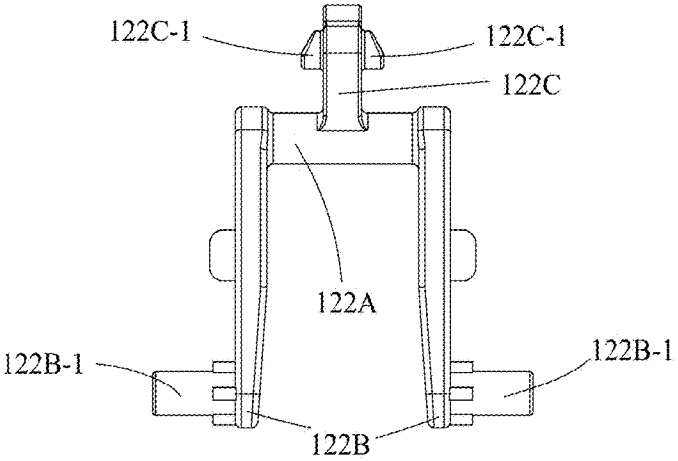
Figure 7A:
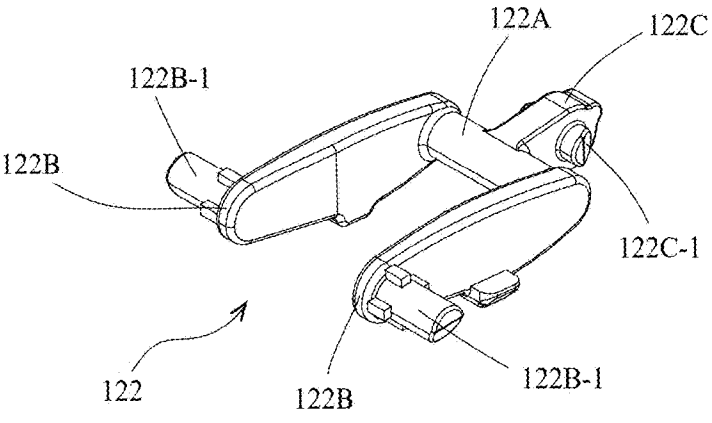
Figure 7C:
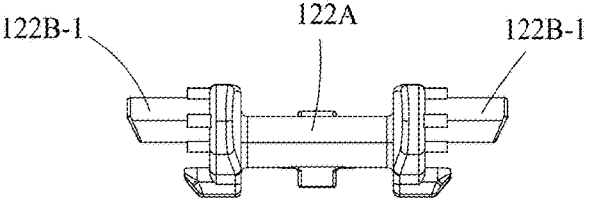

FIGS. 5A to 5C illustrate different views of the connector portion 110, which is sized and shaped to be accommodated within the recessed area of the main body 102. Preferably, when the connector portion 110 is assembled with the main body 102, the resulting structure forms the contour of the upper part of the lid assembly, contributing to its overall external shape and appearance. The connector portion 110 includes two through-holes, designated as 110A, which are intended to receive the axle 106 and the biasing member 108. These through-holes facilitate the mechanical connection between the connector and the lid, and allow the connector to interact dynamically with the lid mechanism. In addition, the connector portion 110 comprises two apertures, designated as 110B, which are aligned with the apertures 102B of the main body 102 and face directly toward them. The size and shape of the apertures 110B, as well as those of the apertures 102B, are designed to properly receive the resilient members 112. As previously mentioned, the number of apertures or resilient members is not a fixed requirement and should not be construed as limiting the scope of the invention. Variations may be implemented depending on specific design needs or functional goals. With the aid of the resilient members 112, the connector portion 110 is configured to reciprocally move between two positions: a first position, in which the connector is displaced away from the main body 102, and a second position, in which it is proximate to the main body 102. This reciprocal movement may serve a functional purpose such as actuating a sealing mechanism, releasing a latch, or engaging another component. To further assist with its movement and mounting within the recessed area of the main body 102, the connector portion 110 is advantageously provided with a leg 110C with an engagement member 110D at the distal end thereof. Advantageously, the engagement member 110D is in a form of a hook.

FIGS. 6A to 6F illustrate different views of the button portion 114. The button portion 114 is designed with a plate 114A and a shaft 114B that is connected to the plate 114A. Advantageously, the diameter of the shaft 114B is dimensioned to fit into the through-hole 102E of the main body 102. Preferably, the length of the shaft 114B is greater than the depth of the through-hole 102E, meaning that when the shaft is fully inserted, a portion of it extends beyond the through-hole. To facilitate the movement of the shaft 114B into and out of the through-hole 102E, the resilient member 116, as shown in FIG. 2, may be included during the assembly of the button portion 114. Advantageously, seals 118 and 120, also shown in FIG. 2, are included in the assembly to ensure proper sealing. Along the length of the shaft 114B, two recesses—namely, recess 114C and recess 114D—are provided to receive seals 118 and 120, respectively. Further along the length of the shaft 114B, there is an engagement member 114E, which is preferably formed as a hook. This engagement member 114E is designed to engage with the corresponding engagement member 110D, also preferably in the form of a hook, located at the distal end of the leg 110C of the connector portion 110. It should be understood that the specific shapes of the engagement members 110D and 114E, as depicted in the figures, are merely illustrative examples and should not be construed as limiting the scope of the present invention. As long as the engagement members are capable of engaging with each other, their exact shapes may vary and still fall within the intended scope of the invention.

FIGS. 7A to 7D show different views of the connector 122. The connector 122 resembles the shape of the Greek letter "x" and comprises a pole 122A, a pair of legs 122B, and an arm 122C. At the end of each leg 122B, there is an outwardly protruding protrusion 122B-1 which can be used to directly or indirectly connect to the main body 102. The direct or indirect connection of the connector enables the connector 122 to rotatably move upwards approaching the bottom side of the top surface of the main body and downwards away from the bottom side of the top surface of the main body. Similarly, at the end of the arm 122C, there is a pair of oppositely facing protrusions, designated as 122C-1. Preferably, the pair of legs 122B are each connected to the two ends of the pole 122A, while the arm 122C is connected to the mid-portion of the pole 122A along its length. More preferably, the legs 122B and the arm 122C extend in opposite directions from the pole 122A.

Figure 8C:
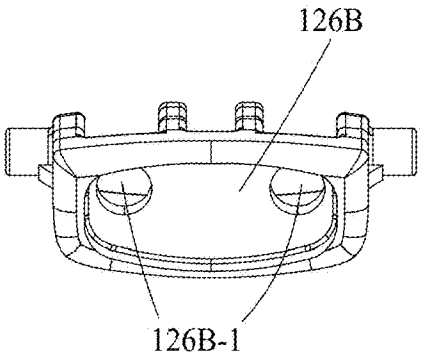
FIGS. 8A-8C are different views of a connector of the present invention.
Figure 8B:
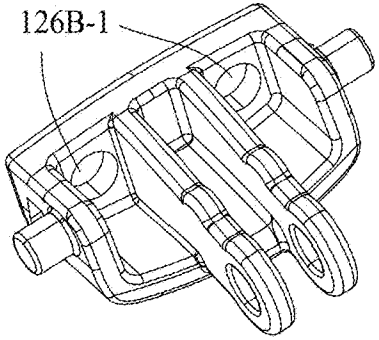
Figure 8A:
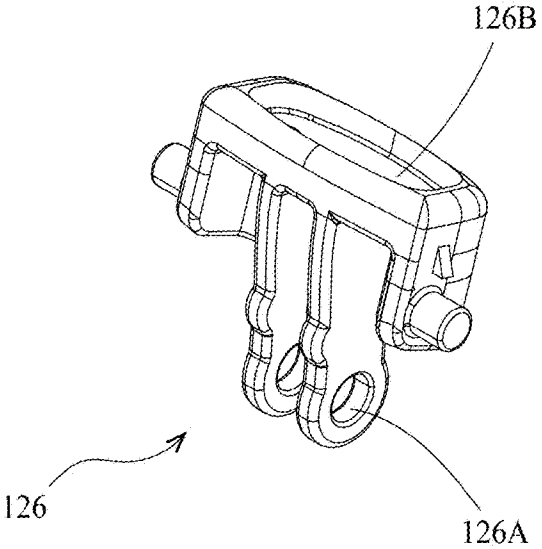

FIGS. 8A to 8C illustrate different views of the connector 126. The connector 126 includes a lower portion with a pair of legs having apertures 126A, and an upper portion comprising a plate 126B that features a plurality of apertures, designated as 126B-1, for receiving the seal 128. The assembly of the apertures 126A and the protrusions 122C-1 of the connector 122 enables movable connection between the seal 128 and the connector 122.

Figure 9B:
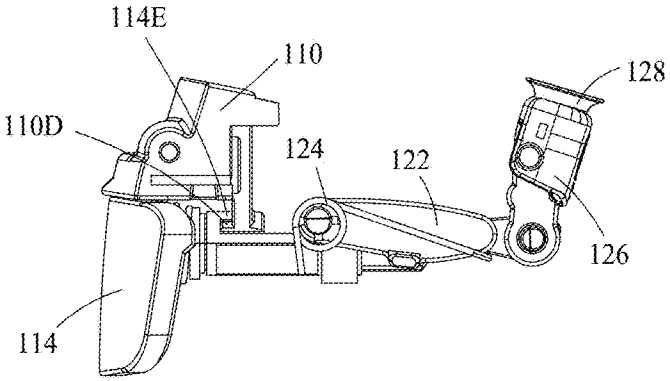
FIG. 9B shows that the connector, the button portion, and the sealing structure of the present invention are in their first positions.
Figure 9C:
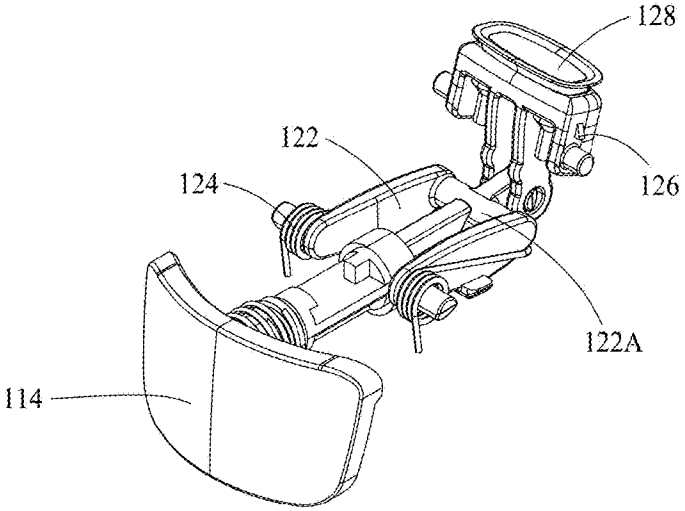
FIG. 9C shows that the button portion and the sealing structure of the present invention are in their first positions.
Figure 9A:
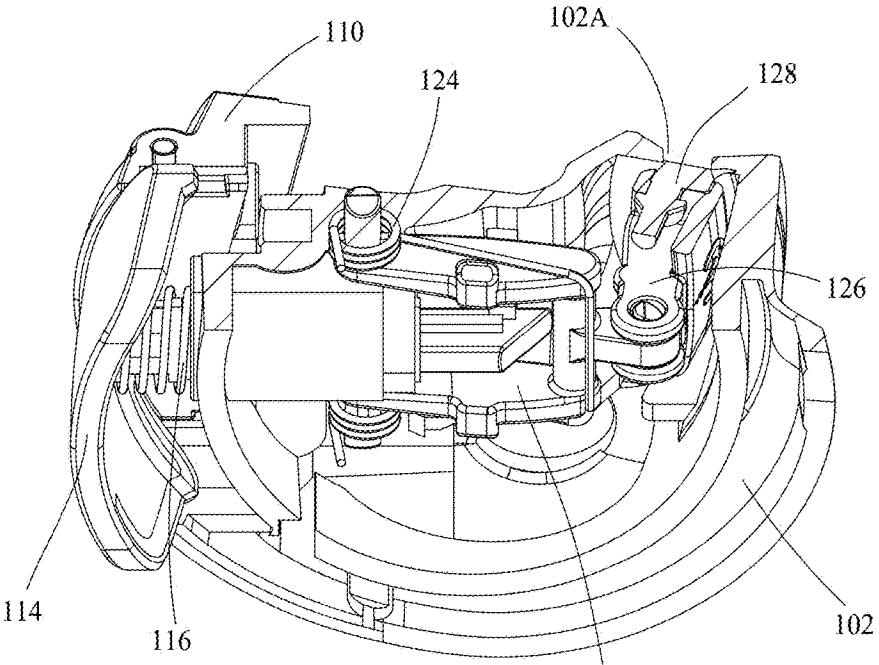
FIG. 9A shows that the connector, the button portion, the main body, a sealing structure of the present invention are in their first positions.
Figure 10B:
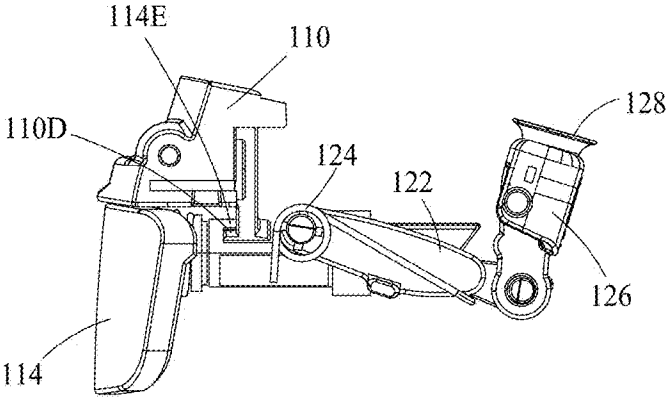
FIG. 10B shows that the connector, the button portion, and the sealing structure of the present invention are in their second positions.
Figure 10C:
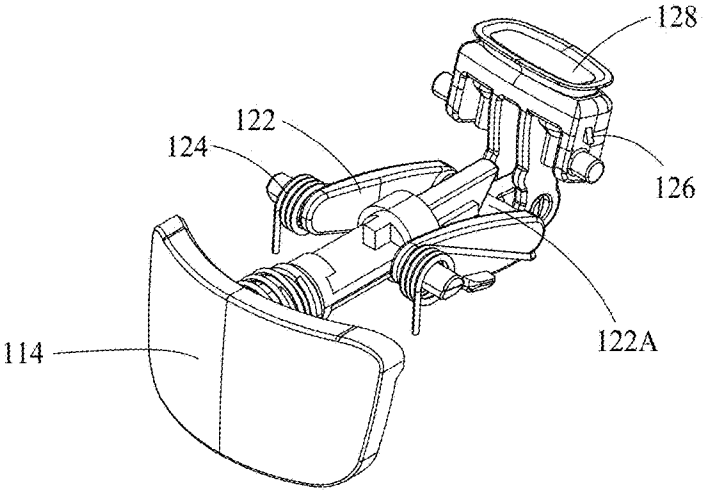
FIG. 10C shows that the button portion and the sealing structure of the present invention are in their second positions.
Figure 10A:
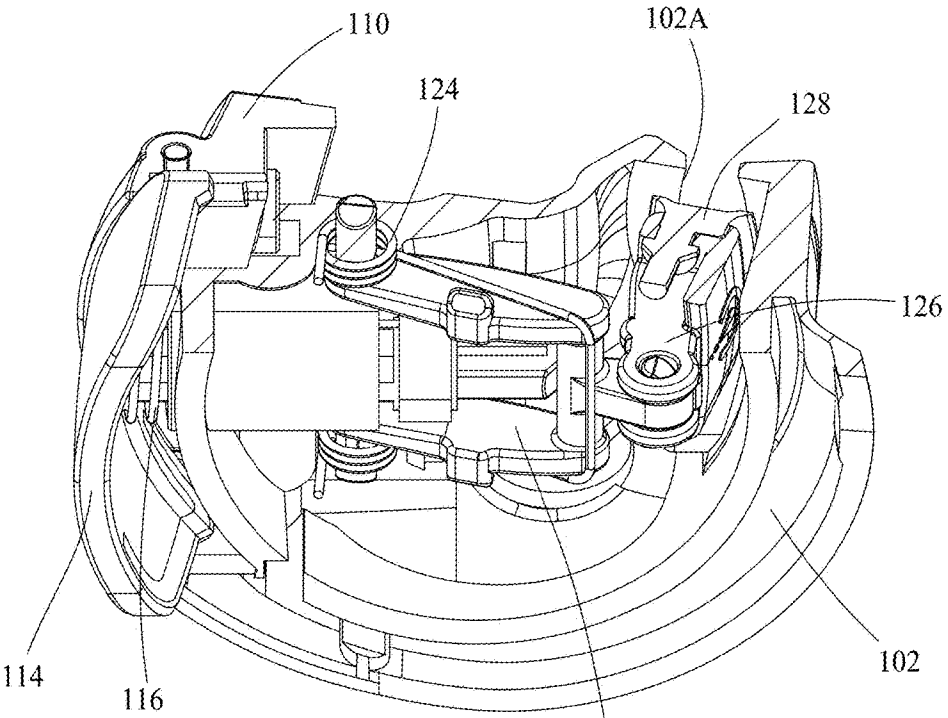
FIG. 10A shows that the connector, the button portion, the main body, a sealing structure of the present invention are in their second positions.

FIGS. 9A and 10A show the assembly of the connector portion 110, the button portion 114, the main body 102, the connector 122, the biasing member 124, and the sealing member which comprises the connector 126 and the seal 128. FIGS. 9B and 10B illustrate the assembly of the connector portion 110, the button portion 114, the connector 122, the biasing member 124, and the sealing member consisting of the connector 126 and the seal 128. FIGS. 9C and 10C depict the assembly of the button portion 114, the connector 122, the biasing member 124, and the sealing member consisting of the connector 126 and the seal 128.

The configurations shown in FIGS. 9A to 9C illustrate the first positions of the movable components, while the configurations shown in FIGS. 10A to 10C depict the second positions of these components. In the configuration shown in FIGS. 9A to 9C, it is illustrated that the engagement member 110D of the connector portion 110 engages with the engagement member 114E of the button portion 114, and that the distal end of the shaft of the button portion 114 engages with the pole 122A of the connector 122. When the user pushes the button portion 114 from its first position to its second position, this movement causes the connector portion 110 to move from its first position to second position as well, due to the interaction between the engagement member 110D of the connector portion 110 and the engagement member 114E of the button portion 114. As the connector portion 110 moves, the resilient member 112 is compressed. For clarity, the resilient member 112 is not shown in FIGS. 9A-9C and 10A-10C. Since the connector portion 110 moves from its first position to its second position, i.e., moving closer to the main body 102, the lid 104 is brought into motion moving closer to the main body 102 as well because the lid 104 connects to the connector portion 110. In the first position of the lid 104, the engagement member 104C (the hook) of the lid 104 engages with the engagement member 102F (the notch) of the main body 102, thus the lid 104 covers the passage 102A. As the lid 104 moves closer to the main body 102, the engagement member 104C (the hook) of the lid 104 begins to disengage from the engagement member 102F (the notch) of the main body 102, initiating the lid 104 to move to its second position to uncover the passage 102A. When the lid 104 is changing from the first position to the second position, two simultaneous actions occur. On one hand, the engagement member 104C (the hook) of the lid 104 disengages from the engagement member 102F (the notch) of the main body 102, the biasing member 108, which is under tension when the lid 104 is at its first position, begins to relax or release the stored energy and thus bouncing up the lid 104 to achieve its second position. On the other hand, the distal end of the shaft of the button portion 114 actuates the pole 122A of the connector 122, thus pushing the connector 122 to move from its first position (the connector is adjacent the bottom side of the top surface of the main body) to its second position (the connector is away from the bottom side of the top surface of the main body), during which, the biasing member 124 is being biased. During the movement of the connector 122 from its first position to its second position, the sealing member moves from its first position sealing the passage 102A to its second position unsealing the passage 102A. When the user releases the button portion 114, the compressed resilient member 116 relaxes and pushes the button portion 114 back from its second position to its first position. At this moment, the distal end of the shaft of the button portion 114 is no longer engaged with the pole 122A of the connector 122. The button portion 114 and the connector portion 110 together defines an actuation system of the present invention. In some embodiments, said button portion and said connector portion are separate parts. In some embodiments, said button portion and said connector portion are integrally formed, and said engagement member of said connector portion and said engagement member of said button portion are permanently engaged. The previously biased biasing member 124 then relaxes, pushing the connector 122 to return from its second position to its first position, thereby pushing the sealing member back from the second position to the first position. It allows users to control the opening and closing of the passage 102A. When the compressed resilient member 116 relaxes, concurrently the compressed resilient members 112 also relaxes, thereby pushing the connector portion 110 to return from its second position to its first position.

Figure 11C:
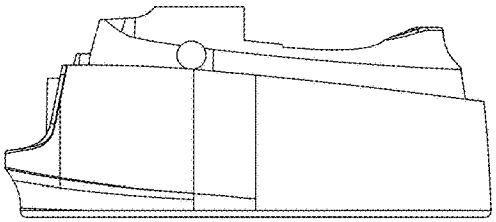
FIGS. 11A-11C are different views of a base member of the present invention.
Figure 11B:
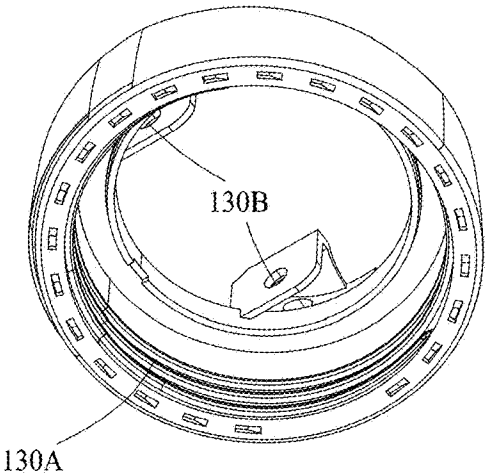
Figure 11A:
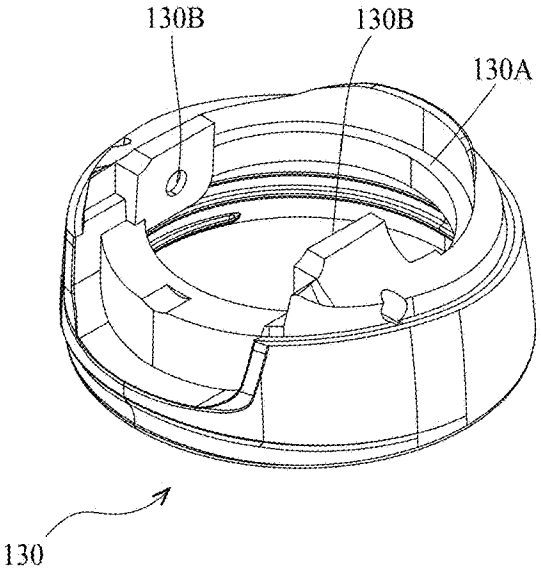
Figure 12B:
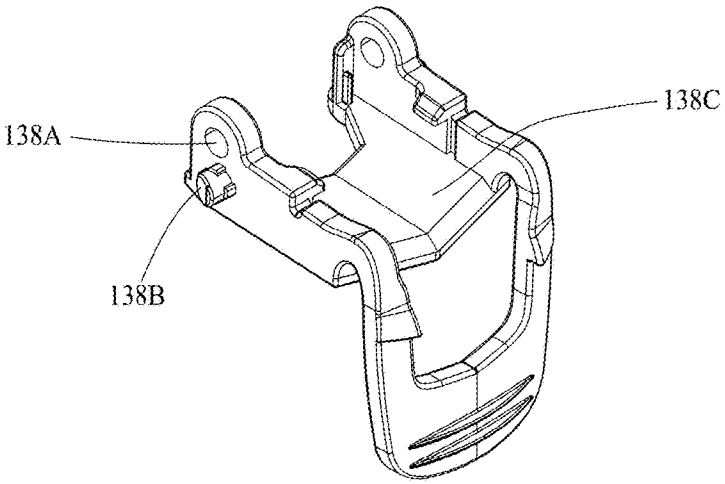
FIGS. 12A-12D are different views of a stage of the present invention.
Figure 12D:
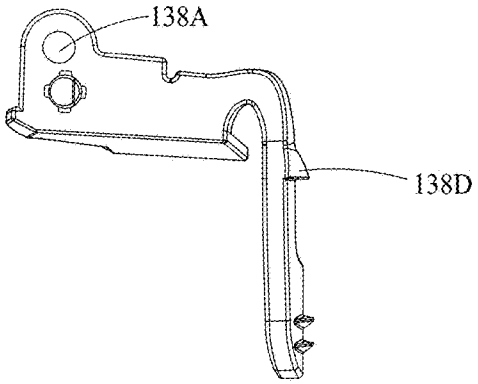
Figure 12A:
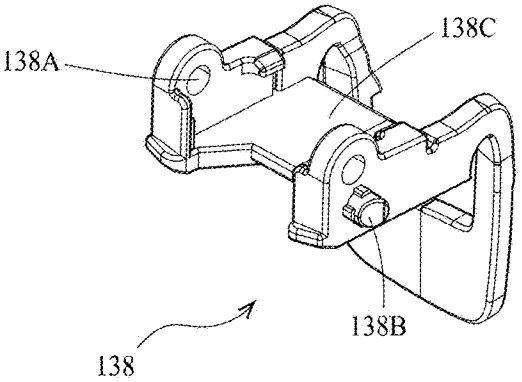
Figure 12C:
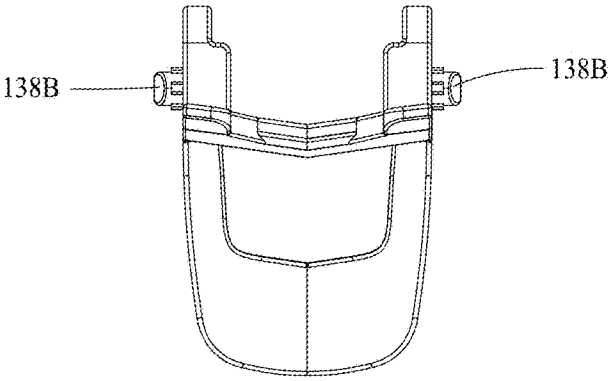

FIGS. 11A-11C show different views of the base member 130. Base member 130 has a ring structure, with its internal circumference featuring threads 130A, which are designed to engage with corresponding threads on a container, allowing for removable mounting of the base member onto the container. The base member 130 is profiled to provide a pair of opposite facing walls, each of the walls is provided with a hole 130B.

FIGS. 12A-12D shows different views of the stage 138, which resembles the shape of the numeral "7". The stage 138 comprises a horizontal portion with a plate 138C, and a vertical portion. The vertical portion is designed to be slightly resilient, meaning it can be compressed inward and then return to its original position relative to the horizontal portion. On opposite sides of the plate 138C, each side is provided with a hole 138A for connection to the protrusion 122B-1, and a protrusion 138B for engagement with the hole 130B of the base member 130. Additionally, the vertical portion of the stage 138 is provided with a pair of protrusions 138D.

Figure 13B:
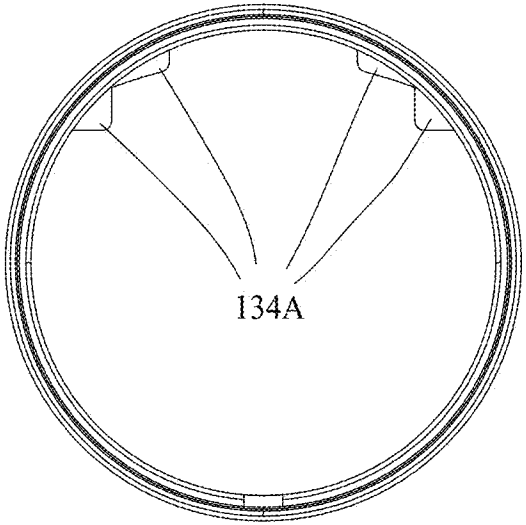
FIGS. 13A-13B are different views of an adapter of the lid assembly of the present invention.
Figure 13A:
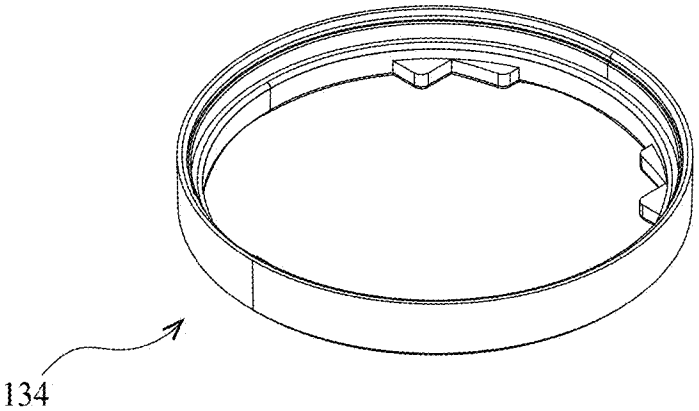

FIGS. 13A-13B are different views of the adapter 134, which has a ring structure and is designed to be smaller than base member 130, such that it can be received within the cavity of base member 130 and can be mounted to the base member 130 with simple mechanical connection for example. Inside the ring structure, a plurality of protrusions 134A are provided, each protruding inwardly. In some embodiments, the base member 130 and the adapter 134 can be integrally formed as one piece, serving as an auxiliary engagement component of the present invention.

Figure 14A:
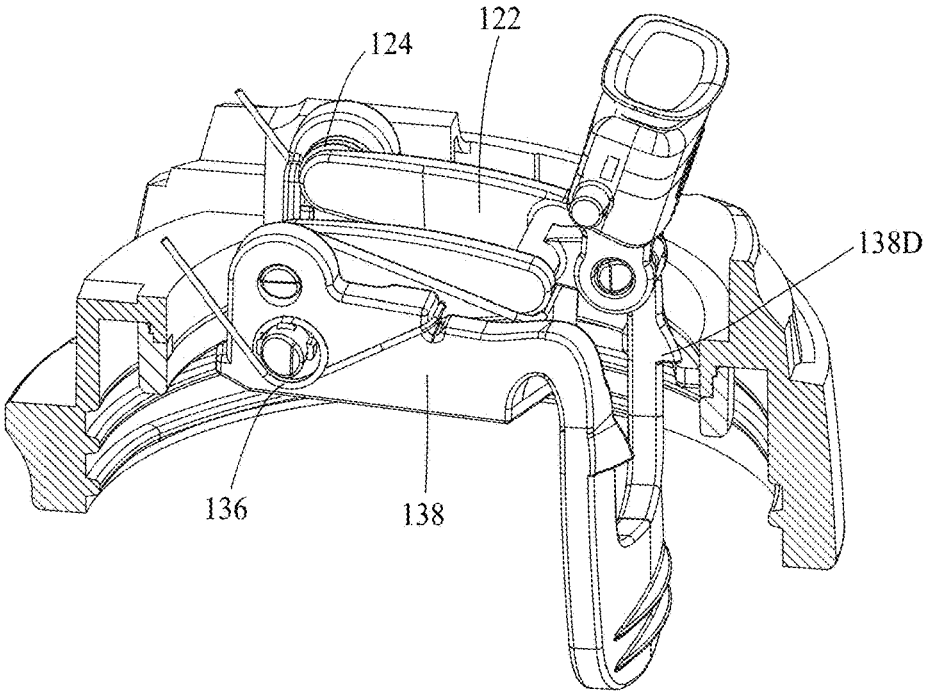
FIG. 14A shows that the stage of the present invention is in its first orientation.
Figure 14B:
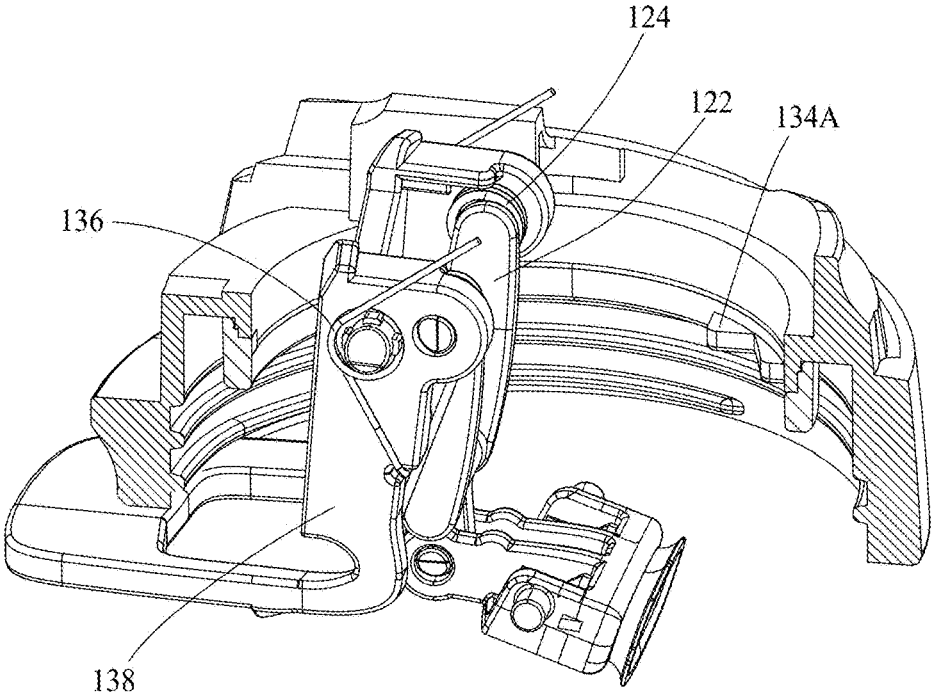
FIG. 14B shows that the stage of the present invention is in its second orientation.
Figure 15A:
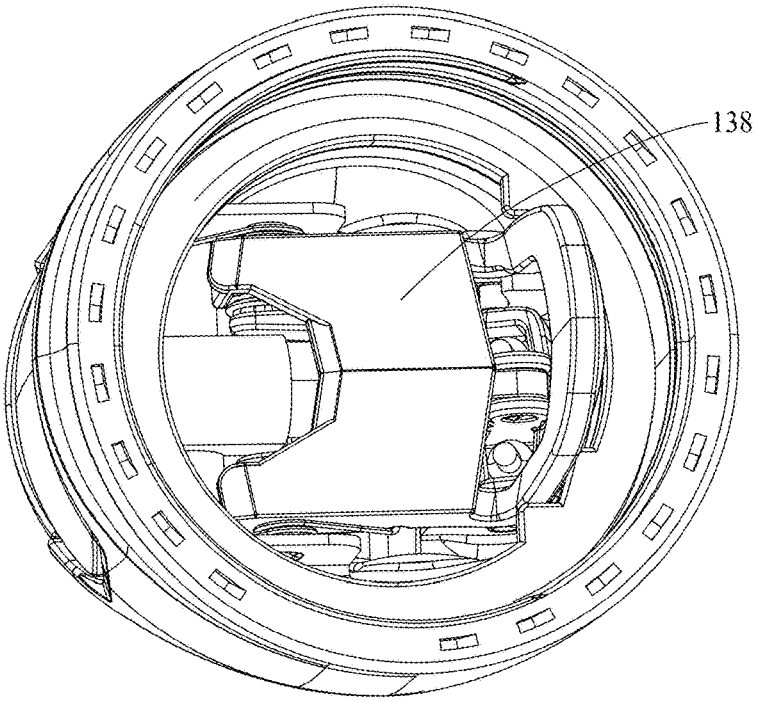
FIG. 15A shows a bottom view of the lid assembly of the present invention.
Figure 15B:
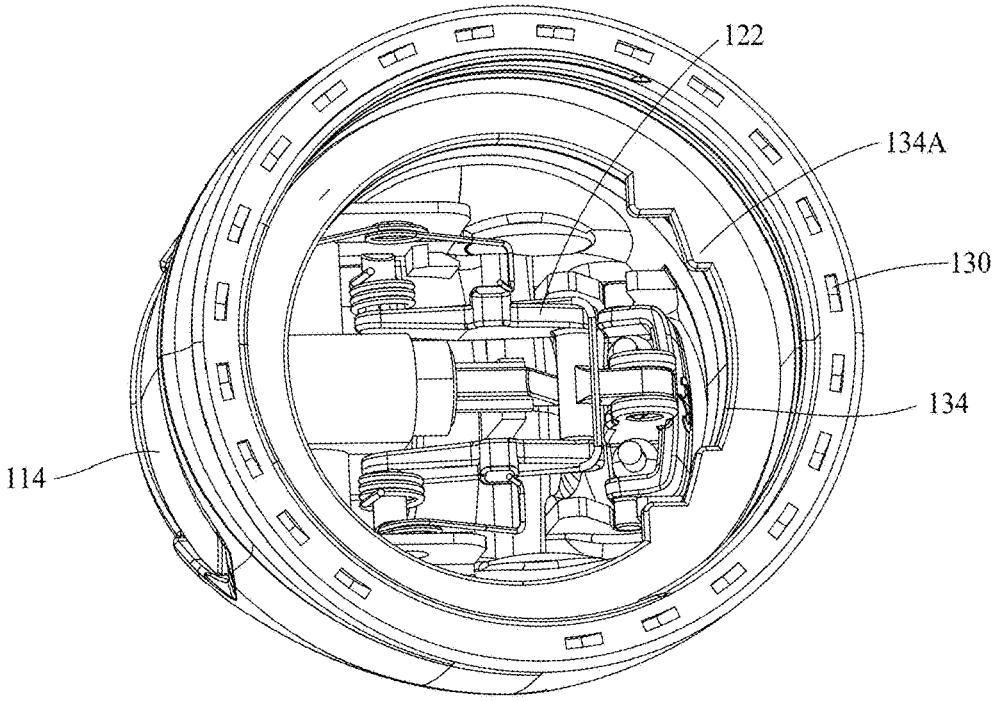
FIG. 15B shows the representation in FIG. 16A but taking away the stage of the present invention.
Figure 16A:
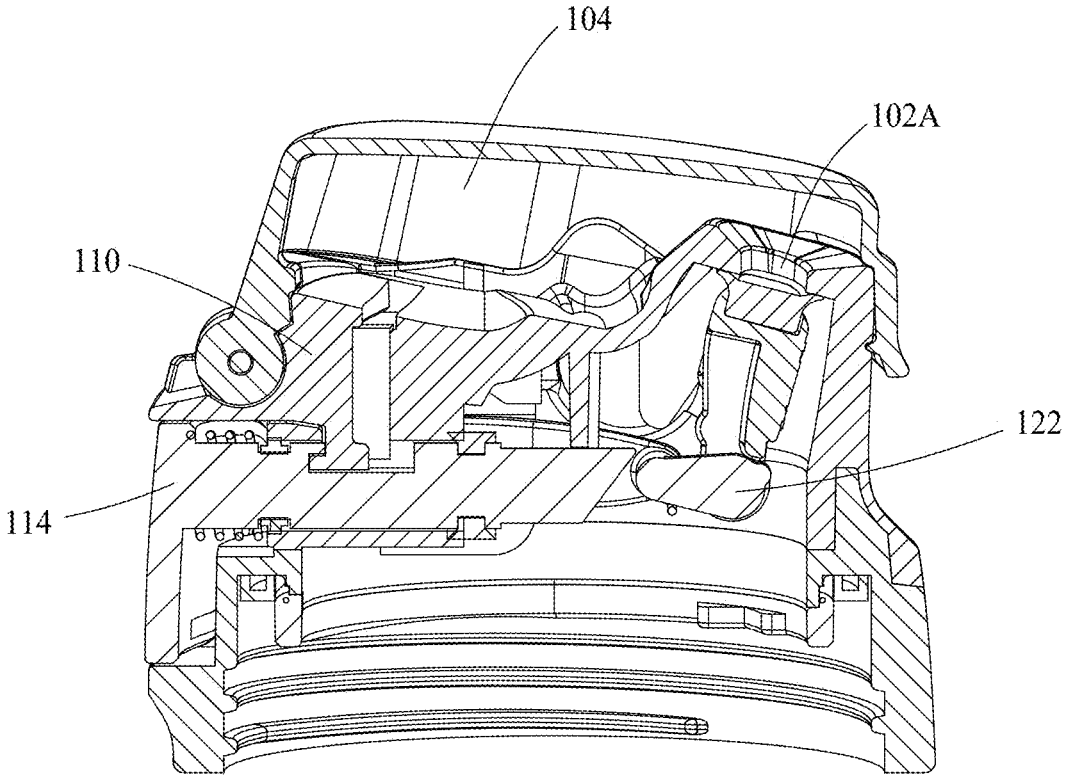
FIGS. 16A-16D shows the opening of the lid from its first position to its second position.
Figure 16B:
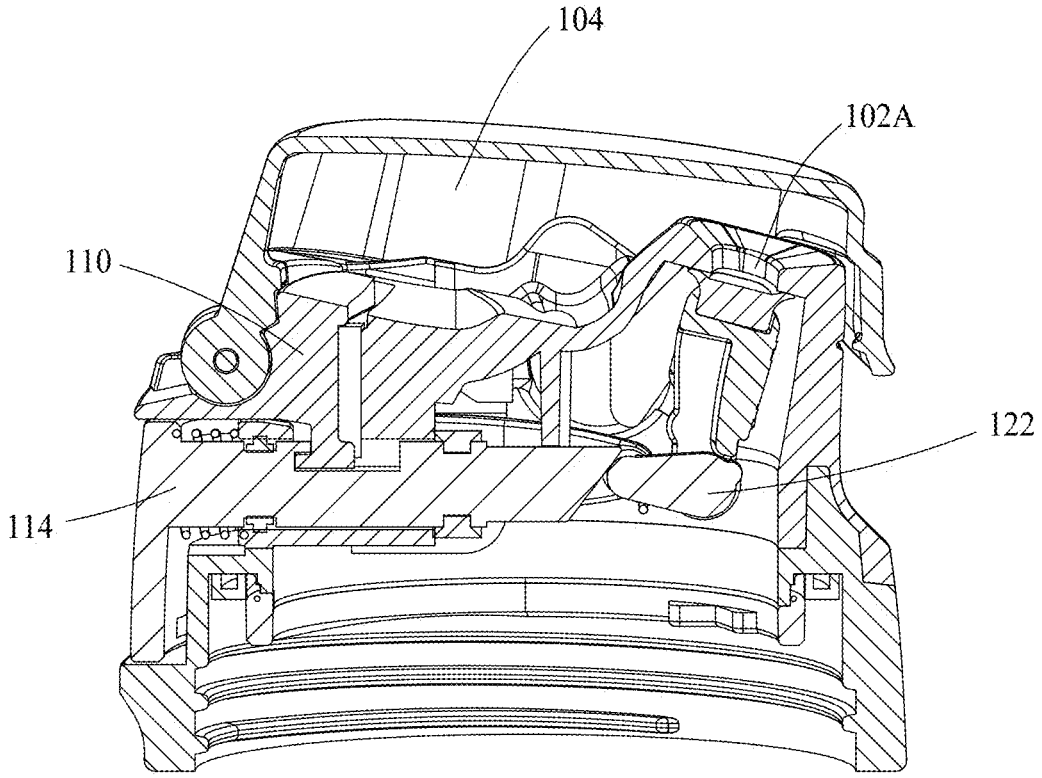
Figure 16C:
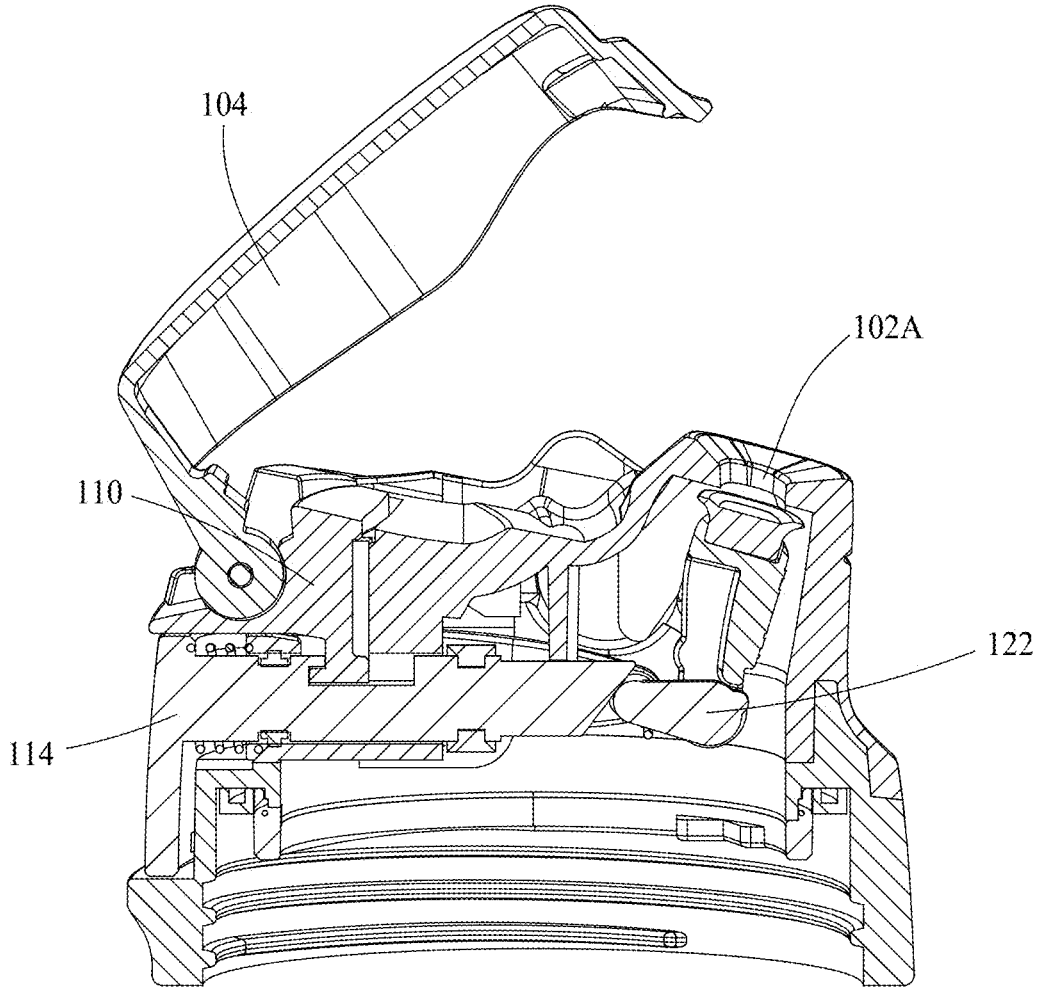
Figure 16D:
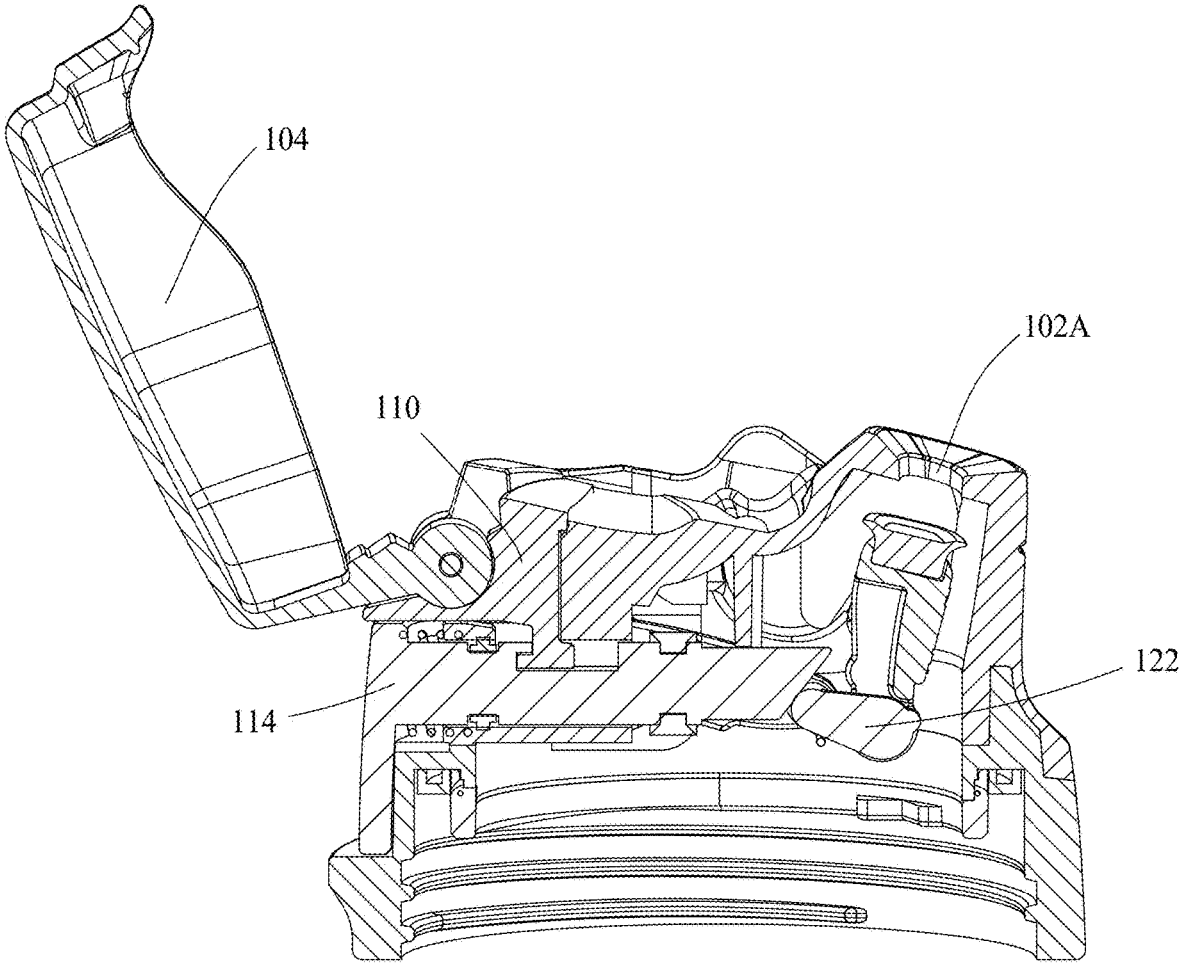

FIGS. 14A-14B and FIGS. 16A-16D illustrate a second embodiment of the present invention, which involves the assembly of the stage 138, the adapter 134, the two biasing members 124 and 136, and the sealing structure (the combination of the connector 122, the connector 126, and the seal 128). As shown, the stage 138 is connected to the base member 130 via the connection between the hole 130B and the protrusion 138B, with the biasing member 136 positioned in between. The connector 122 is connected to the stage 138 via the connection between the hole 138A and the protrusion 122B-1, with the biasing member 124 positioned in between. FIG. 14A shows the stage 138 in its first orientation, with the biasing member 136 under tension, and the sealing structure resting on the plate 138C of the stage 138. This first orientation is maintained by the interaction between the protrusion 138D of the stage 138 and the protrusion 134A of the adapter 134. In fact, the tensioned biasing member 136 also assists in maintaining the stage 138 in its first orientation. When the protrusion 138D of the stage disengages from the protrusion 134A of the adapter 134, the compressed biasing member 136 begins to release its stored potential energy, thereby causing the stage 138 to bounce downward relative to the base member and assume its second orientation, as shown in FIG. 14B. In this second orientation, the sealing structure is outwardly exposed and accessible to users for easy cleaning. In comparison, the sealing structure shown in FIGS. 9A-9C and 10A-10C is inwardly disposed and thus more difficult for users to clean. FIG. 15A shows a bottom view of the second embodiment of the lid assembly of the present invention. FIG. 15B presents the same representation as FIG. 16A, with the stage 138 removed. FIGS. 16A-16D illustrate the opening of the lid from its first position to its second position; its operation is identical to that shown in FIGS. 9A-9C and 10A-10C.

It shall be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. Also, a skilled person in the art would be aware of the prior art which is not explained in the above for brevity purpose. It is to be noted that certain features of the embodiments are illustrated by way of non-limiting examples. For example, the size and shape and position of the disclosed components can be adaptively changed to cater different users' need. The disclosed components are all examples to illustrate the present invention only and shall not construe as limiting to the scope of protection. Those skilled in the art could adjust and/or modify these components according to actual needs, and variations therefrom also fall into the scope of the present invention. For example, "a protrusion" in embodiments can be modify into "a recess", or vice versa; for manufacturing purpose, the base member and the main body in the disclosed invention can be made integrally as one piece as a main member.

What is claimed is:

1. A lid assembly, for a container, comprising:

a main member, removably mounting to said container, having:

a passage fluidically communicable with an interior of said container, a through-hole; and an engagement member;

an actuation system, comprising:

a button portion, having an engagement member, said button portion reciprocally movable inside said through-hole of said main member between a first position and a second position with a first resilient member; and a first connector portion, adjacent said main member and having an engagement member engageable with said engagement member of said button portion, such that said first connector portion being actuated to move, synchronously with the movement of said button portion, between a first position and a second position;

a lid, movably connecting to said first connector portion with a first biasing member and having an engagement member engageable with said engagement member of said main member, said lid being:— maintained at a first position covering said passage when said engagement member of said lid engaging with said engagement member of said main member; and operably moved with said first biasing member to a second position uncovering said passage when said engagement member of said lid disengaging from said engagement member of said main member;

a sealing structure, directly or indirectly connecting to said main member and being actuated to move between a first position closing said passage and a second position opening said passage;

and characterized in that, said button portion moving from its said first position to said second position synchronously:— actuating said sealing structure and said first connector portion to move from their said first position to said second position; and disengaging said engagement member of said lid from said engagement member of said main member.

2. The lid assembly of claim 1, characterized in that, said sealing structure comprising a second connector and a sealing member, said second connector and said sealing member being actuated, by the movement of said button portion, to move between a first position and a second position, wherein said sealing structure moving between its said first position and said second position referring to said second connector and said sealing member moving between their respective said first position and said second position.

3. The lid assembly of claim 2, further comprising a second biasing member, provided to said second connector to facilitate the movement of said second connector between its said first position and second position.

4. The lid assembly of claim 2, characterized in that, said main member providing a track guiding the movement of said sealing member between its said first position and said second position.

5. The lid assembly of claim 1, characterized in that, said lid sliding with a certain extent with respect to the main member before said first biasing member relaxes.

6. The lid assembly of claim 5, characterized in that, said lid sliding in a direction away from said main member.

7. The lid assembly of claim 1, characterized in that, said first connector portion being assembled to said main member, with a second resilient member therebetween, such that said first connector portion being movable between its said first position and second position and moving with respect to said main member.

8. The lid assembly of claim 7, characterized in that, a movable connection between said first connector portion and said lid being adjacent said button portion.

9. The lid assembly of claim 7, characterized in that, a movable connection between said first connector portion and said lid being movable with respect to said main member.

10. The lid assembly of claim 1, further comprising a stage, movably connecting to said main member, such that said stage being configured to assume a first orientation and a second orientation; and said sealing structure movably connecting to said stage.

11. The lid assembly of claim 10, characterized in that, said stage being provided with a third biasing member, such that in said first orientation said stage biasing said third biasing member.

12. The lid assembly of claim 11, characterized in that, said main member further comprising an auxiliary engagement member; said stage being further provided with an engagement member engageable with said auxiliary engagement member, aiding said stage to maintain its said first orientation.

13. The lid assembly of claim 12, characterized in that, when said engagement member of said stage not engaging with said auxiliary engagement member, relaxation of the biased third biasing member reflexing said stage from its said first orientation to said second orientation.

14. The lid assembly of claim 1, characterized in that, said button portion and said first connector portion being separate parts.

15. The lid assembly of claim 1, characterized in that, said button portion and said first connector portion being integrally formed, said engagement member of said first connector portion and said engagement member of said button portion being permanently engaged.

* * * * *